US006139367A

United States Patent [19]

Yeh

[11] Patent Number: 6,139,367

[45] Date of Patent: Oct. 31, 2000

[54] SHIELDED ELECTRICAL CONNECTOR

[75] Inventor: Joel Jyh-Haur Yeh, San Gabrie, Calif.

[73] Assignee: Hon Hai Precision Ind. Co., Ltd., Taipei Hsien, Taiwan

[21] Appl. No.: 09/366,240

[22] Filed: Aug. 3, 1999

[51] Int. Cl.[7] ..... H01R 13/648

[52] U.S. Cl. ..... 439/609; 439/939

[58] Field of Search ..... 439/607, 609, 439/939

[56] References Cited

U.S. PATENT DOCUMENTS

| | | | |
|---|---|---|---|
| 5,637,015 | 6/1997 | Tan et al. | 439/607 |
| 5,702,271 | 12/1997 | Steinman | 439/607 |
| 5,738,544 | 4/1998 | Davis | 439/607 |
| 5,755,595 | 5/1998 | Davis et al. | 439/609 |
| 5,797,770 | 8/1998 | Davis et al. | 439/609 |

*Primary Examiner*—Gary F. Paumen
*Attorney, Agent, or Firm*—Wei Te Chung

[57] ABSTRACT

A shielded connector comprises an insulative housing comprising a vertical wall from opposite faces of which at least one front partition and at least one rear partition extend respectively and substantially parallel to each other. At least one set of right angle contacts each have a horizontal section attaching to one face of the at least one front partition and a vertical section retained in the at least one rear partition. At least one isolator extend forward from the vertical wall of the insulative housing and is parallel to the at least one front partition. At least one inner metal shell is connected to the at least one isolator and spaced away from the horizontal sections of the contacts. An outer metal shell encircles the insulative housing and exposes the at least one front partition and the at least one inner metal shell from an opened front end thereof. The at least one inner metal shell and the vertical sections of the at least one set of contacts are blocked by the vertical wall of the insulative housing.

28 Claims, 7 Drawing Sheets

SHIELDED ELECTRICAL CONNECTOR

BACKGROUND OF THE INVENTION

1. Field of the Invention

The present invention relates to a shielded electrical connector, particularly to a shielded electrical connector having two inner shielding shells enclosing two insulative partitions thus forming three ports for reception of three plug connectors.

2. The Prior Art

Multi-port connectors are popular for achieving compact size compared to simple stacks of several singleport connectors. U.S. Pat. No. 5,797,770 discloses a two-port shielded connector having two plug receiving cavities defined by an inner shielding shell fixed on a protruded portion of an insulative housing and an outer shielding shell encircling the insulative housing. The inner shielding shell is fixed to the insulative housing only by interference engagement to opposite inner walls of the housing. Moreover, the inner shielding shell is proximate to vertical sections of right angle contacts fixed to the housing. The inner shielding shell during assembling of the outer shell to the housing experiences a relatively great wiping force which may overcome the interference engagement between the inner shell and the inner opposite walls of the housing thereby moving the inner shielding shell to the vertical sections of the contacts. Additionally, the inner shell may be moved to contact the vertical sections of the contacts after several times of insertion/withdrawal of the plug connector. It is requisite to provide a new inner shell having a reliable retention to the housing and spaced away from the vertical sections of the contacts by at least a physical portion of the housing in order to guarantee that the inner shell will not shorten to the vertical sections of the contacts during insertion of the plug connector to the multi-port connector.

The two-port connector as disclosed in U.S. Pat. No. 5,797,770 has its vertical sections of contacts exposing to exterior without any metal shielding for prevention of EMI problem. Therefore, a rear shield is required to block the contacts in the rear side of the connector.

Moreover, the two-port shielded connector of the prior art can not be easily modified into a three-port connector because the registration of the vertical sections of the contacts will be a problem when the three-port connector is mounted on a printed circuit board. Therefore, in a three-port connector, an additional spacer device has to be used to solve the registration problem.

U.S. Pat No. 5,637,015 also discloses a two-port shielded connector having a locking plate integrally formed on a mating face of a front shell which encircles an insulative housing receiving a plurality of right angle contacts. The manufacture of the front shell is very difficult because the locking plate should be made by stamping and bending while its location across a central line of the mating face of the front shell will seriously hinder the bending of the cubic structure of the front shell and vice versa. For simplifying the manufacture, the locking plate should be made separately from the front shell for reducing manufacturing cost.

SUMMARY OF THE INVENTION

The primary objective of the present invention is to provide a three-port shielded connector so that each port can receive a complementary plug connector.

Another objective of the present invention is to provide a multi-port shielded connector having an inner shielding shell firmly fixed in a housing thereof without causing unwanted short circuit between the inner shielding shell and contacts received in the housing after a complementary plug connector is repeatedly inserted into and withdrawn out from the port.

Another objective of the present invention is to provide a multi-port shielded connector having a spacer device to position contacts extending from different ports of the connector.

Another objective of the present invention is to provide a multi-port shielded connector having a rear shielding to isolate the vertical sections of the contacts from external.

In accordance with one aspect of the present invention, a shielded connector comprises an insulative housing comprising a vertical wall from opposite faces of which at least one front partition and at least one rear partition extend respectively and substantially parallel to each other. At least one set of right angle contacts each have a horizontal section attaching to one face of the at least one front partition and a vertical section retained in the at least one rear partition. At least one isolator extend forward from the vertical wall of the insulative housing and is parallel to the at least one front partition. At least one inner metal shell is connected to the at least one isolator and spaced away from the horizontal sections of the contacts. An outer metal shell encircles the insulative housing and exposes the at least one front partition and the at least one inner metal shell from an opened front end thereof. The at least one inner metal shell and the vertical sections of the at least one set of contacts are blocked by the vertical wall of the insulative housing.

In accordance with another aspect of the present invention, a shielded connector comprises an insulative housing comprising a vertical wall from front and rear faces of which three front partitions and three rear partitions extend, respectively and substantially parallel to each other. A first set of right angle contacts each have a horizontal section attaching to one face of a highest one of the front partitions and a vertical section retained in a highest one of the rear partitions. A second set of right angle contacts each have a horizontal section attaching to one face of a middle one of the front partitions and a vertical section retained in a middle one of the rear partitions. A third set of right angle contacts each have a horizontal section attaching to one face of a lowest one of the front partitions and a vertical section retained in a lowest one of the rear partitions. Two isolators extend forward from the vertical wall of the insulative housing and substantially are staggered with the three front partitions. Two inner metal shells are respectively connected to the isolators and spaced away from adjacent front partitions. A positioning socket is connected to the insulative housing and has two rows of holes for respectively receiving vertical sections of the first set of contacts and the second set of contacts. An outer metal shell encircles the insulative housing and exposes the front partitions and the inner metal shells from an open front end thereof.

DETAILED DESCRIPTION OF THE PREFERRED EMBODIMENT

Figure 1:
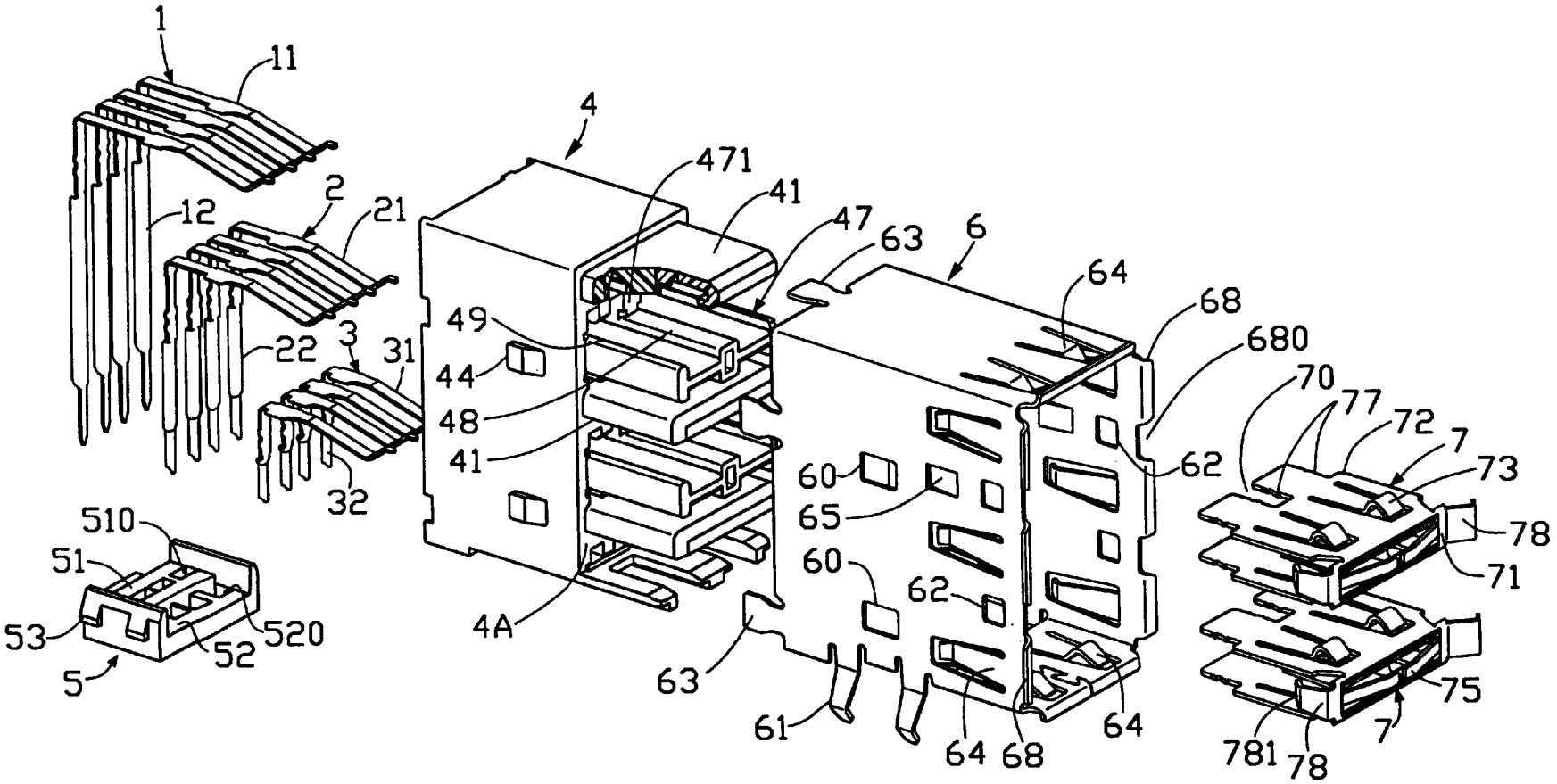
FIG. 1 is an exploded view of a shielded connector in accordance with the present invention with some portions of the isolator being cut away to show the internal structures and the engagement tang of the inner shell not being bent.
Figure 2:
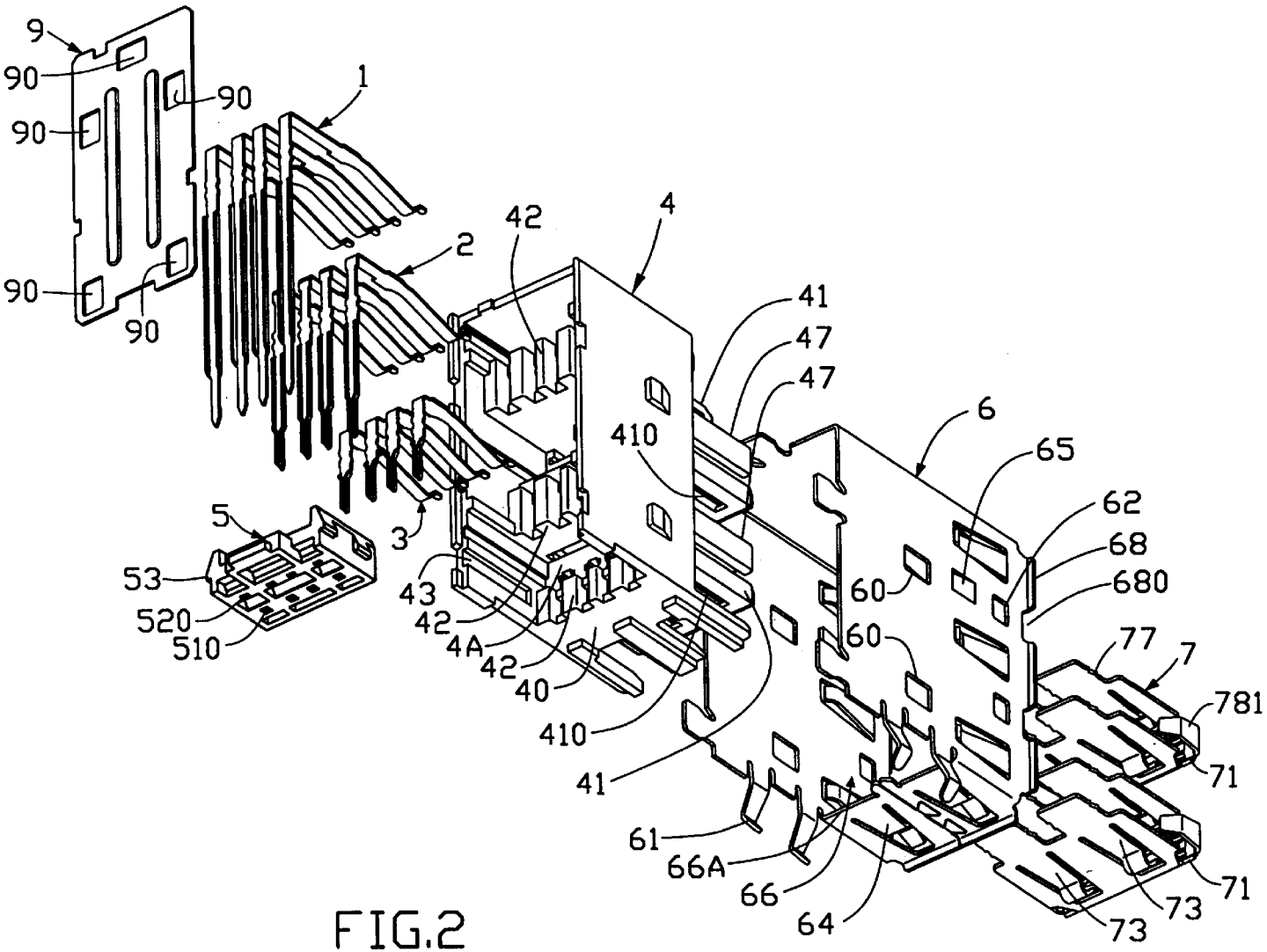
FIG. 2 is an exploded view of a shielded connector of FIG. 1 taken from a different angle adding a rear shield.

Referring to FIGS. 1 and 2, a shielded connector in accordance with the present invention comprises three sets of contacts 1, 2, 3. Each contact 1, 2, 3 is a right angle contact having a horizontal section 11, 21, 31 for contacting with a corresponding pin of a complementary plug connector not shown and a vertical section 12, 22, 32 for connection to a printed circuit board not shown. An insulative housing 4 comprises a vertical wall 4A from opposite faces of which three front partitions 41 and three rear partitions 42 extend, respectively and substantially parallel to each other. Two isolators 47 extending forward from the vertical wall 4A are staggered between the three front partitions 41. Each front partition 41 has four passageways 410 extend horizontally side by side along an underside thereof for receiving the horizontal sections 11, 21, 31 of the contacts 1, 2, 3. A portion of an upper front partition 41 is intentionally removed for illustration of the isolator 47. Tapered protrusions 44 are formed in opposite sides of the vertical wall 4A. Bottom stands 45 extend forward from the vertical wall 4A. Each isolator 47 has a central flange 48 and two side flanges 49 extend from opposite faces thereof. A rib 471 extends from the central flange 48 to one of the front partitions 41. At the rear side of the housing 4, two recesses 43 are formed in opposite inner side faces of the housing 4.

Figure 7:
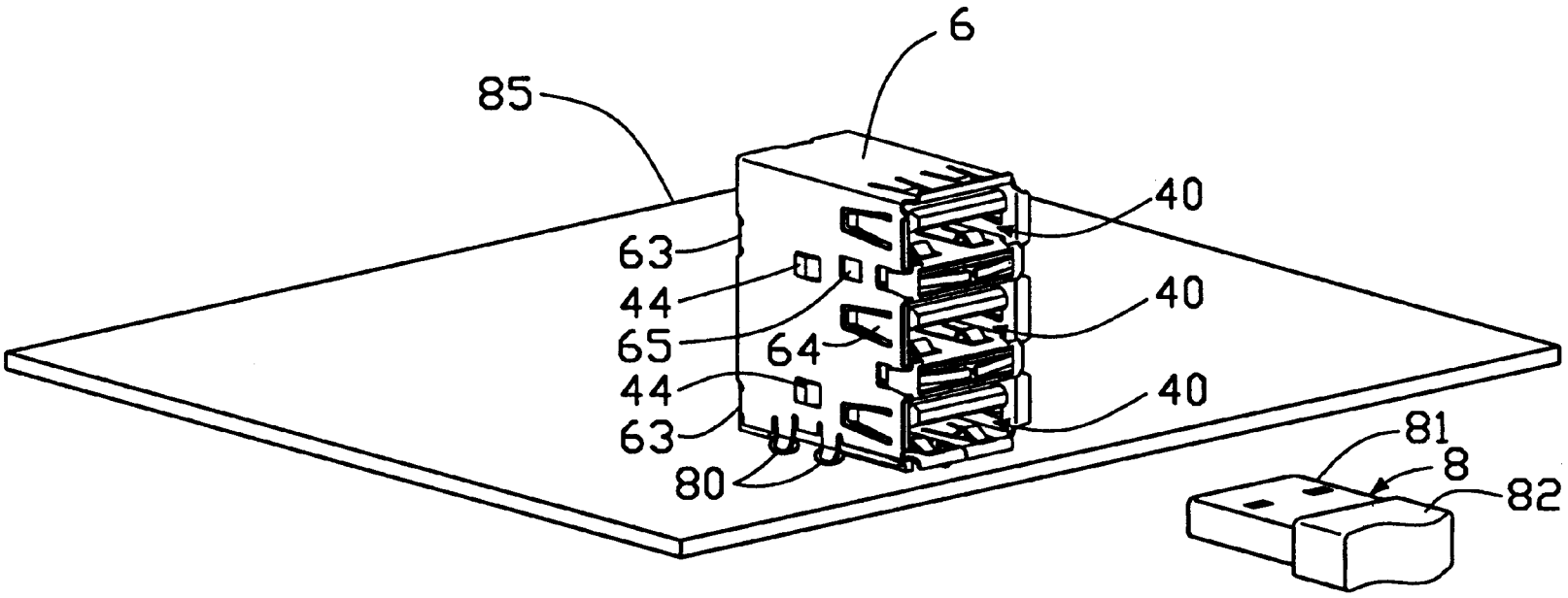
FIG. 7 is an assembled view of the shielded connector to a printed circuit board and a complementary plug connector adapted to be inserted into the shielded connector.

An outer metal shell 6 has a bottom opening 66 formed at a bottom wall thereof and a front open end and a rear open end (not labeled). Two first holes 60 are formed in opposite side faces thereof for engaging with the tapered protrusions 44 when it is moved to encircle the housing 4. Curved plates 68 extend from front edges of the outer shell 6 for contacting with a rear metal panel of a personal computer not shown and two V-shaped cutouts 680 are defined in each front edge of the outer shell 6. Two second holes 62 are formed in each of the side faces near an front edge thereof. A plurality of tangs 63 extend from rear edges of the shell 6. A plurality of resilient tabs 64 are formed in four faces of the outer shell 6. Particularly, each side face of the outer shell 6 has three resilient tabs 64 vertically aligned and each pair of opposite tabs 64 in the side faces is substantially in alignment with a corresponding front partition 41. Two terminals 61 extend downward from bottom edge of each side face for connection to openings 80 through a printed circuit board 8 (FIG. 7). A blocking tab 65 is formed by stamping in each side face and extends inward. The blocking tabs 65 in opposite side faces of the outer metal shell 6 are coplanar with an edge 66A of the bottom opening 66.

Figure 3:
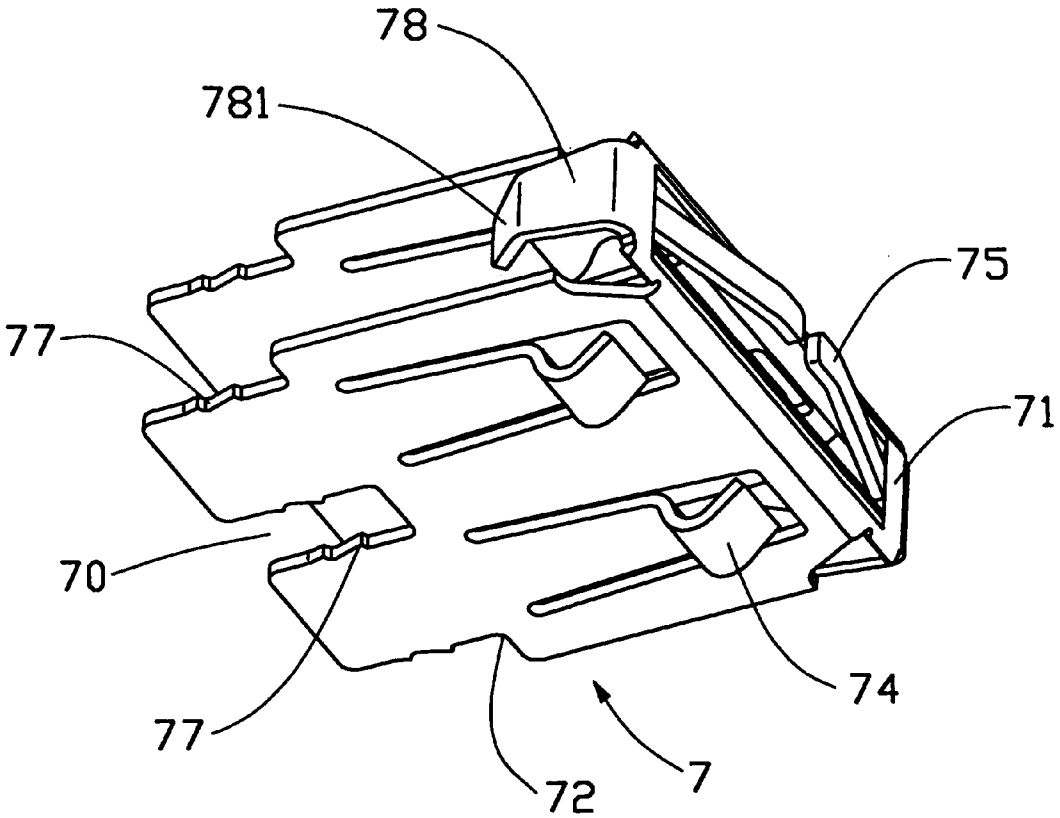
FIG. 3 is an enlarged view of an inner shell of FIG. 1.

Also referring to FIG. 3, a pair of inner shells 7 are made of metal and each inner shell 7 has a clamping shape for connecting to a corresponding isolator 47. The inner shell 7 comprises a middle plate 71 and two side plates 72 extending from opposite edges of the middle plate 71. A cutout 70 is formed in each side plate 72 and includes barbs 77 in opposite inner peripheries of the cutout 77. Barbs 77 are also formed in side edges of the side plate 72. Two resilient tabs 73 are formed in each side plate 72 and each resilient tab 73 has a curved end (not labeled) for contacting with inserted plug connector. Two engagement tangs 78 extend substantially along the same extended direction of the side plate 72 from two ends of the middle plate 71 and each tang 78 has a bent end 781. Two tabs 75 are formed by stamping on the middle plate 71.

A positioning socket 5 has a substantially U-shaped structure and comprises a step base including an upper surface 51 and a lower surface 52. Four positioning holes 510, 520 are formed in the upper surface 51 and the lower surface 52 respectively. Two engagement tapers 53 are projected from opposite side walls of the positioning socket 5 for configuring into the recesses 43 of the housing 4 when the positioning socket 5 is engaged in the housing 4.

A rear shielding 9 has four reception holes 90 formed near edges thereof mating with the tangs 63 of the outer shell 6 for engagement with the tangs 63 during assembly.

Figure 4:
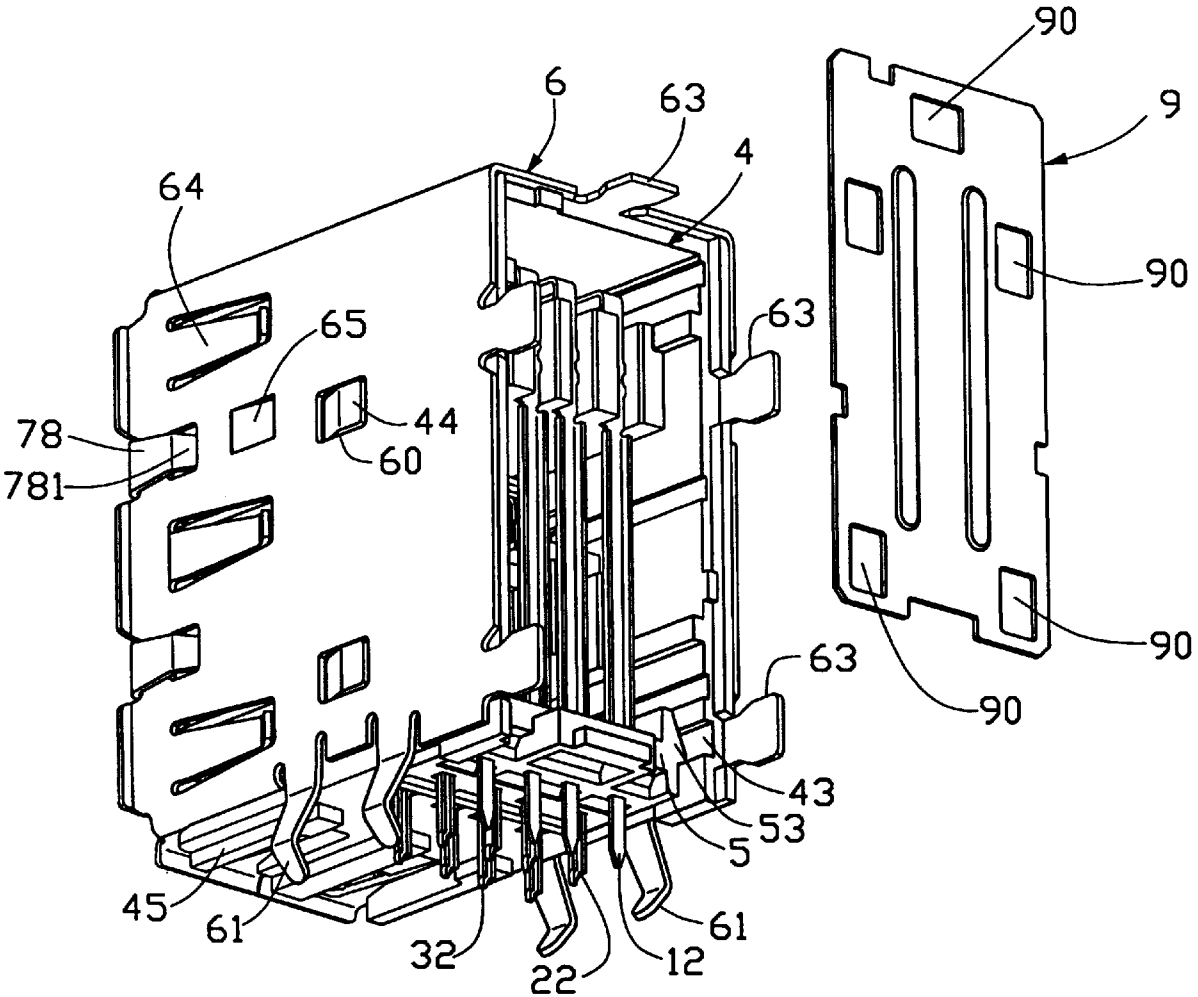
FIG. 4 is a semi-assembly view of FIG. 2, with the rear shield separating from the semi-assembly.
Figure 5:
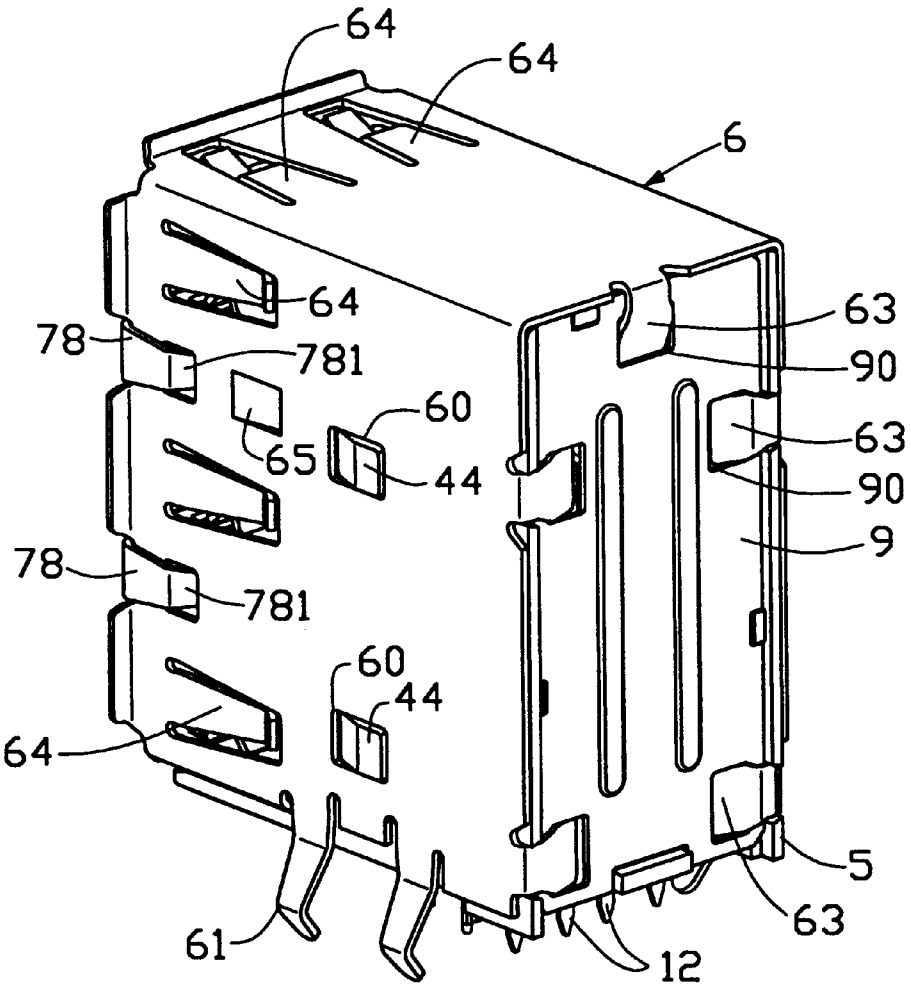
FIG. 5 is an assembled view of FIG. 4 particularly showing the rear face thereof.

Particularly referring to FIGS. 1, 2 and 4, in assembling, the contacts 1, 2, 3 are respectively installed in the housing 4, with the horizontal sections 11, 21, 31 received in the three front partitions 41 and the vertical sections 12, 22, 32 respectively retained in the three rear partitions 42. Specifically, the vertical sections 12, 22 due to the length thereof only have upper portions retained in the rear partitions 42 which cause the lower portions having difficulty to register with corresponding openings of the printed circuit board (not shown). Therefore, the positioning socket 5 is then configured with the housing 4 by forcing the engagement tapers 53 into the recesses 43 of the housing 4, with the vertical sections 11, 21 being retained in the holes 510, 520. After the positioning socket 5 is configured with the housing 4, the outer shell 6 is moved rearward to encircle the housing 4 until the edge 66A of the bottom opening 66 and the blocking tabs 65 abut against a front face of the vertical wall 4A, meanwhile the engaging the holes 60 engage with the tapered protrusions 44. Since the insulative housing 4 has a relative height, the existence of the blocking tabs 65 and the edge **66*a* of the bottom opening 66 of the outer metal shell 6 can facilitate the configuration of the insulative housing 4 and the outer metal shell 6. After the outer shell 6 is configured with the housing 4, the rear shielding 9 is put in a rear portion of the housing 4 and the tangs 63 are bent for engagement with the five reception holes 90 of the rear shielding 9 for firmly fixing the rear shielding 9 in position, as shown in FIG. 5**.

Figure 6:
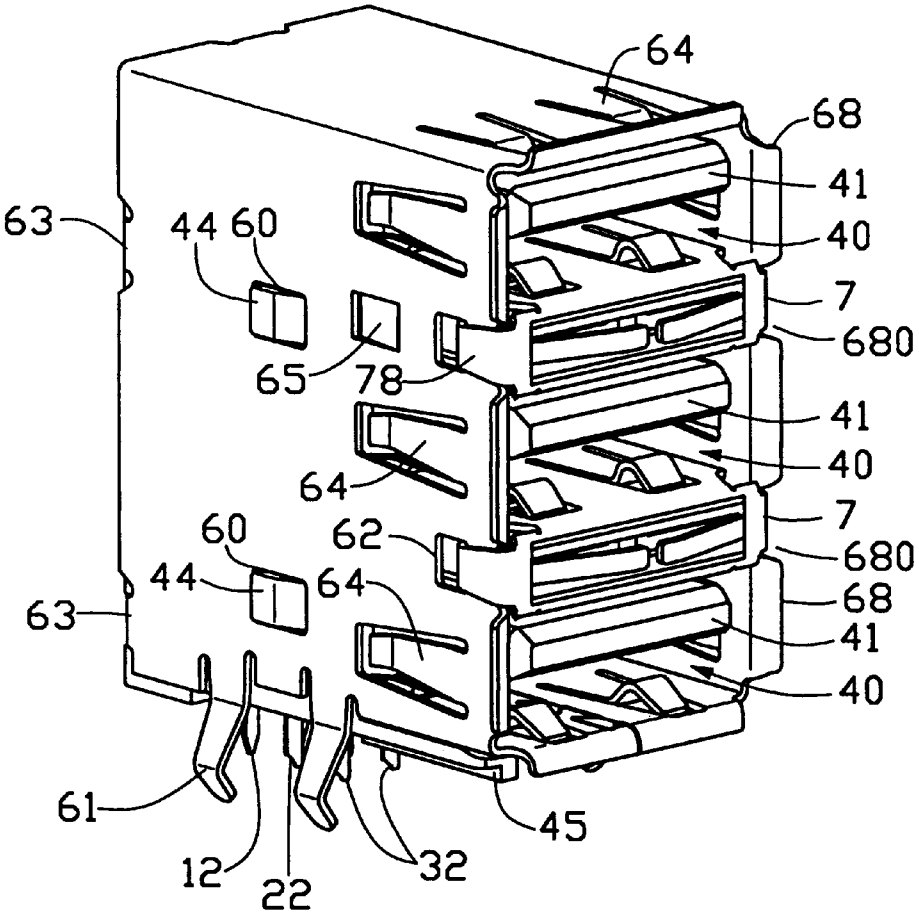
FIG. 6 is an assembled view of FIG. 4 particularly showing the front face thereof.

Referring to FIG. 6, the inner shells 7 are configured with the isolators 47 by clamping opposite faces of the latter with the side plates 72, meanwhile the barbs 77 at inner opposite edges of the cutout 70 engages with opposite sides of the rib 471 and barbs 77 at two sides of the side plate 72 engage with opposite inner faces of the vertical wall 4A. At the same time, the bent ends 781 of the tangs 78 are engaged with the second holes 62 of the outer shell 6. It should be noted that the V-shaped cutout 680 between adjacent curved plates 68 facilitate the assembling of the tang 78 with the second hole 62. The tabs 75 are used to contact with a metal rear panel (not shown) of a personal computer for grounding purpose. Since the inner shell 7 and the vertical sections 12, 22, 32 of the contacts 1, 2, 3 are spaced by the vertical wall 4A, they can be guaranteed never short circuit to each other. The resilient tabs 73 formed on the side plate 72 of the inner metal shell 7 are staggered with the flanges 48 of the isolator 47 when the inner metal shell 7 is connected to the isolator 47. The resilient tabs 73 of the side plate 72 of the inner shell 7 are staggered with the flanges 48, 49 of the isolator 47 after the inner shell 7 is connected to the isolator 47. After configuration of inner shells 7 and the outer shell 6, three plug reception cavities 40 are defined around the front partitions 41 and surrounded by portions of the outer shell 6 and the inner shell 7. Each plug reception cavity 40 can receive a corresponding plug connector 9 (FIG. 7) which has an outer metal shielding 91 extending from an insulative housing 92. The plug connector 9 when inserted into the plug reception cavity 40 will electrically and mechanically contact with the resilient tabs 64 of the outer shell 6 and the resilient tabs 73 of the inner shell 7 thereby increasing the grounding area of the two connectors.

While the present invention has been described with reference to a specific embodiment, the description is illustrative of the invention and is not to be construed as limiting the invention. Therefore, various modifications to the present invention can be made to the preferred embodiment by those skilled in the art without departing from the true spirit and scope of the invention as defined by the appended claims.

What is claimed is:

1. A shielded connector comprising:

an insulative housing comprising a vertical wall from opposite faces of which at least one front partition and at least one rear partition extend respectively and substantially parallel to each other;

at least one set of right angle contacts each having a horizontal section attached to one face of the at least one front partition and a vertical section retained in the at least one rear partition;

at least one isolator extending forwardly from the vertical wall of the insulative housing and parallel to the at least one front partition;

at least one inner metal shell connected to the at least one isolator and spaced away from the horizontal sections of the contacts; and an outer metal shell encircling the insulative housing and exposing the at least one front partition and the at least one inner metal shell from an opened front end thereof;

wherein the at least one inner metal shell and the vertical sections of the at least one set of contacts lie on opposite side of and are blocked by the vertical wall of the insulative housing.

2. The shielded connector as claimed in claim 1, wherein the at least one inner metal shell has a middle plate and two side plates extending from two edges of the middle plate for clamping the at least one isolator.

3. The shielded connector as claimed in claim 2, wherein the at least one inner metal shell has two tangs extending from two ends thereof for engagement with opposite side walls of the outer metal shell when the at least one inner metal shell is connected to the at least one isolator.

4. The shielded connector as claimed in claim 3, wherein the middle plate of the at least one inner metal shell has a tab extending therefrom for electrically contacting with a metal panel of a personal computer.

5. The shielded connector as claimed in claim 4, wherein the side plates of the inner metal shell has barbs formed in edges thereof for engagement with the isolator.

6. The shielded connector as claimed in claim 5, wherein the isolator has flanges extending from opposite side faces thereof for contacting with the inner metal shell.

7. The shielded connector as claimed in claim 5, wherein the side plate has resilient tabs formed therein staggered with regard to the flanges of the isolator when the inner metal shell is connected to the insulative housing.

8. The shielded connector as claimed in claim 3, wherein the outer metal shell has curved plates extending from front edges thereof for contacting with a rear metal panel of a personal computer in which the shielded connector is located.

9. The shielded connector as claimed in claim 8, wherein a V-shaped cutout is defined between adjacent curved plates of vertical front edges of the outer metal shell for facilitating engagement between the tangs and corresponding holes in opposite side walls of the outer metal shell.

10. A shielded connector comprising:

an insulative housing comprising a vertical wall from front and rear faces of which three front partitions and three rear partitions extend, respectively and substantially parallel to each other;

a first set of right angle contacts each having a horizontal section attached to one face of a highest one of the front partitions and a vertical section retained in a highest one of the rear partitions;

a second set of right angle contacts each having a horizontal section attached to one face of a middle one of the front partitions and a vertical section retained in a middle one of the rear partitions;

a third set of right angle contacts each having a horizontal section attached to one face of a lowest one of the front partitions and a vertical section retained in a lowest one of the rear partitions;

two isolators extending forwardly from the vertical wall of the insulative housing and substantially staggered between the three front partitions;

two inner metal shells respectively connected to the isolators and spaced away from adjacent front partitions;

a positioning socket connected to the insulative housing and having two rows of holes for respectively receiving vertical sections of the first set of contacts and the second set of contacts; and an outer metal shell encircling the insulative housing and exposing the front partitions and the inner metal shells from an open front end thereof.

11. The shielded connector as claimed in claim 10, wherein the outer metal shell has a bottom opening and a pair of blocking tabs formed in opposite side faces thereof substantially coplanar with an edge of the bottom opening so that when the outer metal shell is configured with the insulative housing, the blocking tabs and the edge of the bottom opening will abut against a front face of the vertical wall of the insulative housing.

12. The shielded connector as claimed in claim 10 further comprising a positioning socket fixed in a lower portion of the insulative housing for positioning vertical sections of the first set of right angle contacts and the second set of right angle contacts.

13. The shielded connector as claimed in claim 12, wherein the positioning socket has a stepped surface defining two rows of holes therein for receiving the vertical sections of the first set of right angle contacts and the second set of right angle contacts.

14. The shielded connector as claimed in claim 13, wherein the positioning socket has tapers projected from opposite sides thereof for engagement within recesses defined in the insulative housing.

15. The shielded connector as claimed in claim 10, wherein the inner metal shell has a middle plate and two side plates extending from two edges of the middle plate for clamping one of the isolators.

16. The shielded connector as claimed in claim 15, wherein the inner metal shell has two tangs extending from two ends thereof for engagement with opposite side walls of the outer metal shell when the inner metal shell is connected to the isolator.

17. The shielded connector as claimed in claim 15, wherein the middle plate of the inner metal shell has a tab extending therefrom for electrically contacting with a metal panel of a personal computer.

18. The shielded connector as claimed in claim 15, wherein the side plate of the inner metal shell has barbs formed in edges thereof for engagement with the isolator.

19. The shielded connector as claimed in claim 15, wherein the isolator has flanges extending from opposite side faces thereof for contacting with the inner metal shell.

20. The shielded connector as claimed in claim 19, wherein the side plate of the inner metal shell has resilient tabs formed therein staggered with regard to the flanges of the isolator when the inner metal shell is connected to the isolator.

21. A shielded connector for use within a computer case, comprising:

an insulative housing comprising a vertical wall from which at least two front partitions extend forward in a spatially parallel relationship;

two sets of contacts respectively positioned on said two front partitions;

an isolator forwardly extending from said vertical wall and parallel to and between said two front partitions;

an outer metal shell encircling the housing including the front partitions and the isolator, said outer shell defining an open front end exposing said two front partitions and said isolator; and an inner metal shell defining means for being inserted onto and attached to the isolator from said front end of the outer shell.

22. The connector as claimed in claim 21, wherein said inner shell includes means for fastening to the outer shell.

23. The connector as claimed in claim 21, wherein said inner shell includes at least one tab extending forward in front of the isolator for engagement with a panel of said computer case.

24. A shielded connector for use within a computer case, comprising:

an insulative housing comprising a vertical wall from which at least one front partition extends forwardly;

a plurality of contacts respectively positioned on said front partition;

an isolator forwardly extending from said vertical wall and parallel to said front partition;

an outer metal shell encircling the housing including the front partition and the isolator, said outer shell defining an open front end exposing said front partition and said isolator; and an inner metal shell attached to the isolator from said open front end and including at least one first tab facing the front partition for engagement with a mating connector, and at least one second tab for engagement with a panel of said computer case.

25. The connector as claimed in claim 24, wherein said inner shell further includes at least one engagement tang for fastening to the outer shell.

26. The connector as claimed in claim 24, wherein said first tab, second tab and engagement tang extend respectively from three different planes perpendicular to one another.

27. A method for assembling a shielded connector, comprising the steps of:

forming an insulative housing with a vertical wall from which at least two front partitions and an isolator extend forwardly and the isolator is positioned parallel to and between said two partitions;

disposing two sets of contacts onto the corresponding partitions, respectively, from a rear portion of the housing;

assembling an outer metal shell to the housing from a front portion of the housing, said outer shell encircling the housing; and assembling an inner metal shell to the isolator from the front portion of the housing wherein said inner shell defines at least two tabs respectively and oppositely facing the corresponding front partitions.

28. The method as claimed in claim 27, further including a step of fastening the outer shell and the inner shell together.

* * * * *